United States Patent [19]

Butka

[11] Patent Number: 4,802,429

[45] Date of Patent: Feb. 7, 1989

[54] VESSEL SUCH AS A SHIP, BOAT AND THE LIKE PROVIDED WITH STABILIZING MEANS

[76] Inventor: Kemal Butka, 372 Central Park West, Apt. 20 J, New York, N.Y. 10025

[21] Appl. No.: 96,966

[22] Filed: Sep. 11, 1987

[51] Int. Cl.[4] ..... B63B 39/02

[52] U.S. Cl. ..... 114/124

[58] Field of Search ..... 114/39.1, 65 R, 65 A, 114/89, 90, 91, 93, 121, 1, 126, 127, 140, 142

[56] References Cited

U.S. PATENT DOCUMENTS

| | | | |
|---|---|---|---|
| 80,884 | 8/1868 | Stevens et al. | 114/93 |
| 559,983 | 5/1896 | McLean | 114/124 |

FOREIGN PATENT DOCUMENTS

| | | | |
|---|---|---|---|
| 2316118 | 3/1977 | France | 114/39.1 |
| 13670 | 3/1904 | Norway | 114/124 |

*Primary Examiner*—Joseph F. Peters, Jr.
*Assistant Examiner*—Edwin L. Swinehart
*Attorney, Agent, or Firm*—Michael J. Striker

[57] ABSTRACT

A vessel such as a ship, a boat and the like, comprises a main part having a hull with an inner hollow and a substantially vertical fixed support fixedly connected with the hull, and a stabilizing element located in the inner hollow and cooperating with the fixed support so that when the main part turns about a horizontal axis in a first direction under the action of waves, wind and the like, the stabilizing element urges to turn the main part back about the same horizontal axis in a second direction which is opposite to the first direction so as to stabilize the ship.

13 Claims, 3 Drawing Sheets

VESSEL SUCH AS A SHIP, BOAT AND THE LIKE PROVIDED WITH STABILIZING MEANS

BACKGROUND OF THE INVENTION

The present invention relates to a vessel such as a ship, boat or the like. More particularly it relates to a ship, a boat and the like provided with stabilizing means.

It is known to provide a stabilizing means for ships, boats for the purpose of reducing their rolling motion. In general, the stabilizing means respond to force of wind and waves and perform corrective actions. An active stabilizer has a preset control, whereby the corrective action in form of counteracting movement takes place simultaneously with the current of the destabilizing movement that causes the rolling of the ship, boat or the like. The known stabilizing means include from simple bilge keels, to retractible keels, and more advanced gyrostabilizers. These devices contribute to correcting the disturbances by performing responding actions. However, they do not guarantee keeping the ships, boats and the like in a continuously stable and balanced position, and moreover, they are rather complicated.

Ships, boats and the like with stabilizing means are also known, in which a stabilizing element is arranged inside the body of a vessel, and acts upon a mast which is movable relative to the vessel so as to restore it to the initial position. Such a solution also possesses several disadvantages and among them the fact that movement of the mast relative to the body of the vessel is generally undesirable.

SUMMARY OF THE INVENTION

Accordingly, it is an object of the present invention to provide a vessel such as a ship, boat and the like with stabilizing means, which avoids the disadvantages of the prior art and is a further improvement of the self-stabilizing vessels.

In keeping with these objects and with others which will become apparent hereinafter, one feature of the present invention resides, briefly stated, in a vessel such as a ship, boat and the like, comprising a main part having a hull with an inner hollow and a substantially vertical fixed support fixedly connected with said hull, and a stabilizing element located in said inner hollow of said hull and cooperating with said fixed support so that when said main part turns about any horizontal axis in a first direction under the action of waves, wind and the like, said stabilizing element urges to turn said main part back about the same any horizontal axis in a second direction which is opposite to said first direction, so as to stabilize the ship.

In the vessel in accordance with the present invention, the hull and the fixed support are fixedly connected with one another, and the stabilizing means is cooperating with the fixed support, in contrast to known constructions in which the stabilizing means was connected to a movable support. The vessel of the present invention is characterized by high stabilizing efficiency and has a simple construction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
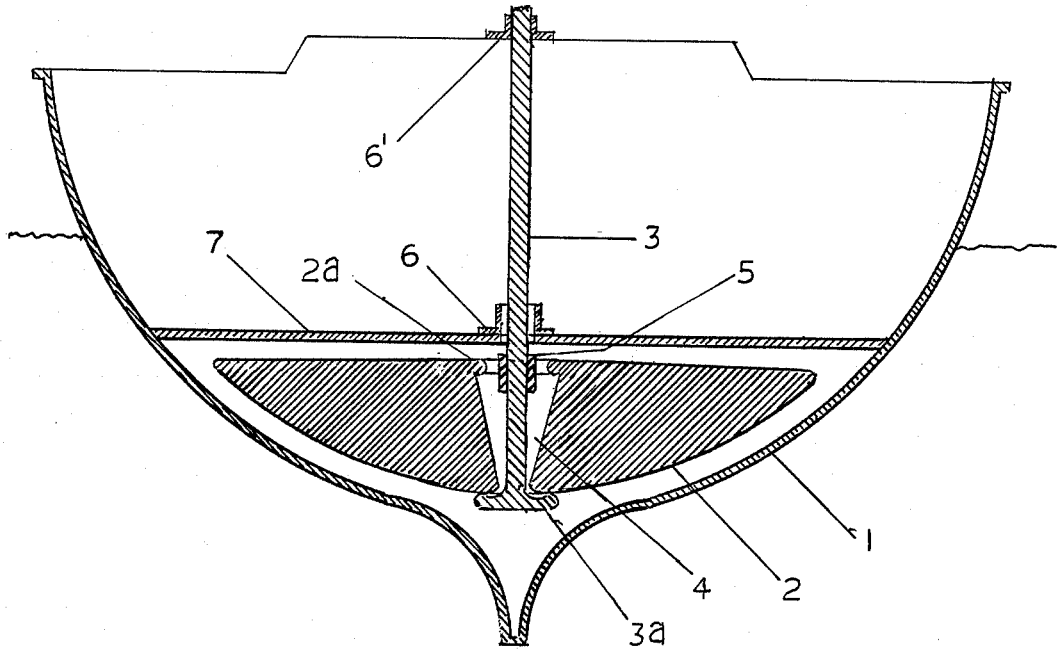
FIG. 1 is a view showing a cross-section of a vessel in accordance with the present invention in a stable position.

A vessel in accordance with the present invention has a main part which includes a hull 1 and a fixed support which is identified with reference numeral 3 and fixedly connected with the hull 1. The fixed support 3 is connected with the hull 1 in any suitable manner, for example by two bushings 6 and 6'. The connection is performed so that the hull 1 and the fixed support 3 are fixedly connected with one another so that no relative movement between these members is possible.

As can be seen from the drawings, the hull 1 has a lower space formed near the bottom of the hull and separated from an upper space by a partition 7. A stabilizing element 2 is located in the lower space of the hull. The stabilizing element 2 has a central passage 4 through which the fixed support 3 passes and is rotation-symmetrical with respect to the vertical axis. As can be seen from the drawings, the central passage is conical and its diameter increases upwardly. At the upper end the central passage is limited by a projection 2a, while at substantially the same location the fixed support 3 is provided with a ring 5 which can be for example of rubber.

The fixed support 3 has a lower end provided with a bottom disc 3a which in operation is located under the stabilizing element 2 and has a diameter which is greater than the diameter of the lower end of the central passage 4 of the stabilizing element 2.

Figure 2:
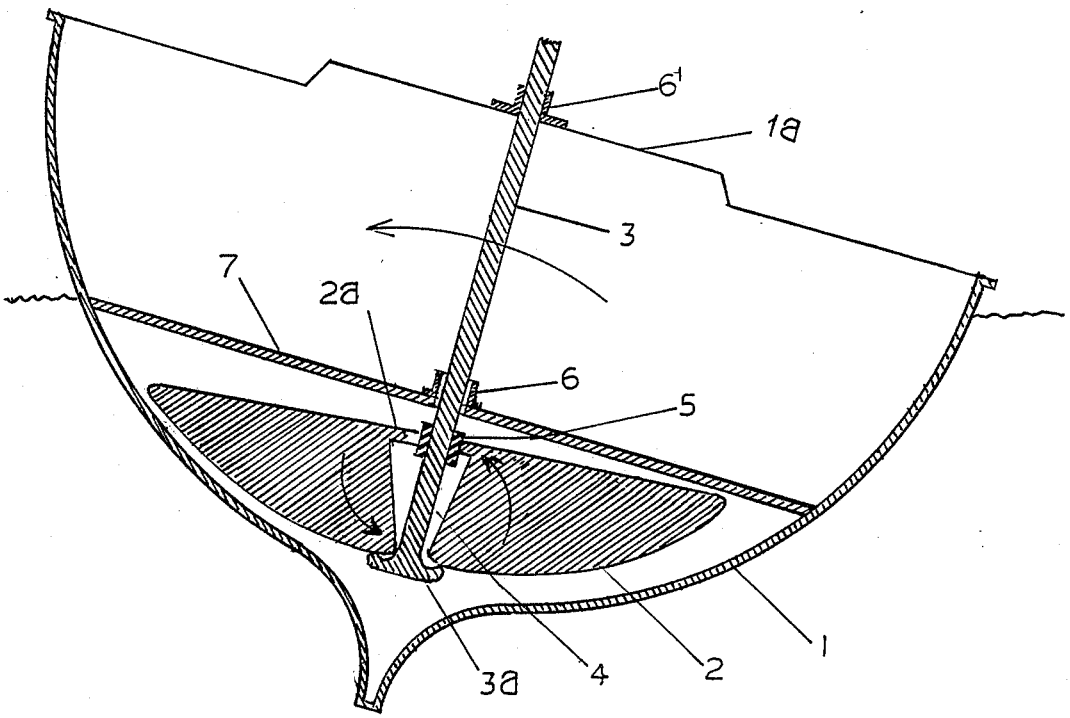
FIG. 2 is a view showing the vessel of FIG. 1 in which under the action of waves or wind movement, the vessel is inclined.

The stabilizing action of the stabilizing system of the inventive vessel is believed to be understood from the consideration of the description and the drawings. When waves or wind movement causes turning of the vessel about any horizontal axis to an inclined position shown in FIG. 2, and the hull 1 with the fixed support 3 are inclined in a predetermined direction, for example to the right in FIG. 2, the stabilizing element 2 under the action of its weight turns in an opposite direction. The lower left edge of the central passage 4 of the stabilizing element 2 presses the lower end of the fixed support 3 to the right, while the right edge of the projection 2a presses a higher point of the fixed support 3 to the left, so as to create a moment which stabilizes the vessel. As can be seen from the drawings, the stabilizing element 2 is not fixably attached to the fixed support 3. Even though to a certain degree the stabilizing element 2 would have similar counteracting effect if it were attached fixedly to the fixed support 3, the swing effect induced by the vessel 1 would retard and thus diminish the counteracting capacity of the stabilizing element. In contrast, in accordance with the present invention when the support 3 is fixedly connected to the hull of the vessel while the stabilizing element is movable relative to the fixed support, the swinging effect is instantly converted into the stabilizing counteraction.

Figure 3:
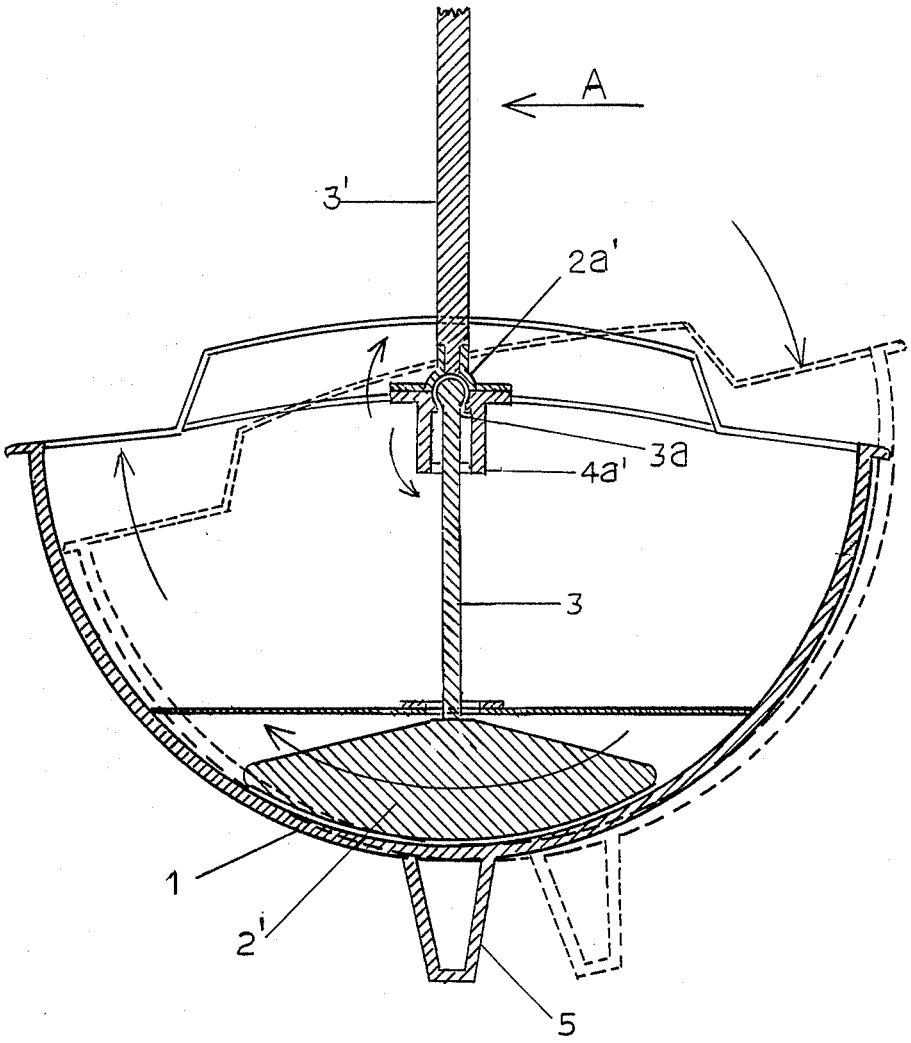
FIG. 3 is a view showing the vessel in accordance with a further embodiment of the present invention.

In the embodiment of FIG. 3, the fixed support includes a mast 3' which is fixedly connected with the hull 1. The stabilizing element 2' is also arranged in the lower space of the hull and suspended on a suspending member 3. The fixed support is formed here as a collar 4a' which is fixedly connected with the hull. The vessel is also provided with a mast 3' which is fixedly connected with the hull. During turning of the hull with the fixed support 4a' and the mast 3', the stabilizing element 2' or more particularly its suspending member 3, abuts against the edge of the lower opening of the collar 4a' and also creates a moment which stabilizes the vessel. As can be seen from FIG. 3, the upper end of the suspending member 3 is provided with a substantially spherical projection 3a which is received in a substantially spherical groove 2a' in the lower end of the mast 3', to allow a guided turning of the suspending member 3 and the mast 3' relative to one another.

Figure 4:
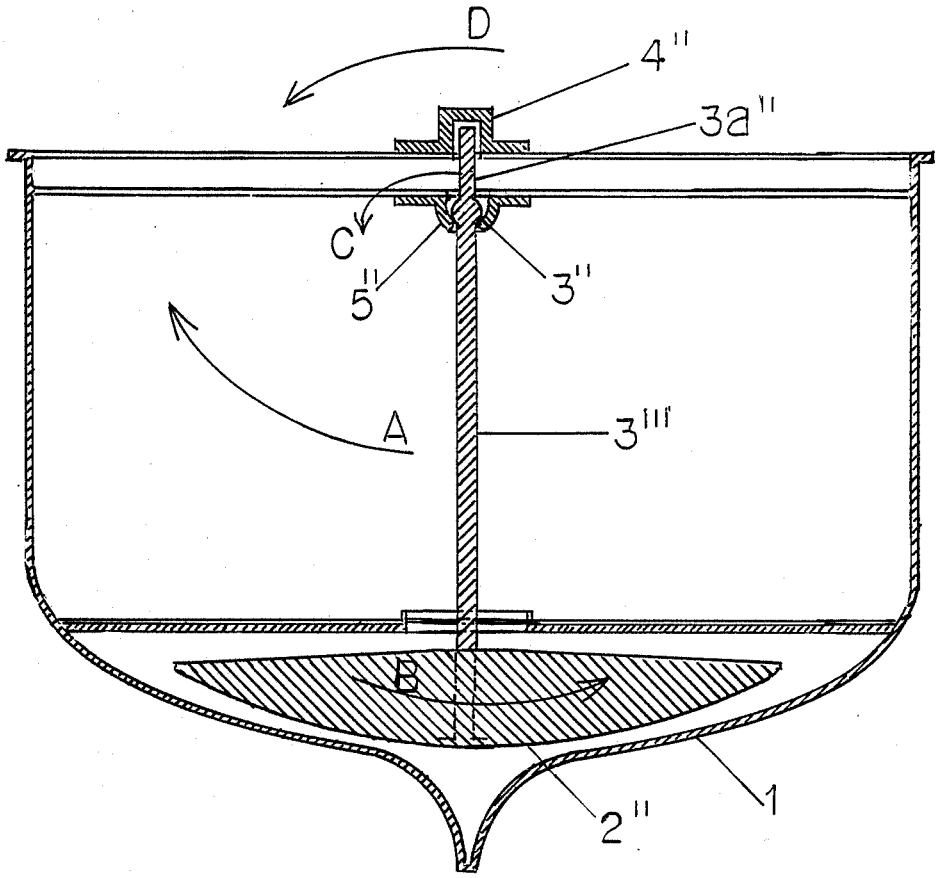
FIG. 4 is a view showing a vessel in accordance with another embodiment of the present invention.

In the embodiment of FIG. 4 the stabilizing system differs from that of FIG. 3 in that it counteracts both the heeling over and the rolling of the vessel 1". The fixed support in the embodiment of FIG. 4 is formed by a flange 4" which is fixedly connected with the hull. The stabilizing element 2" also has a suspending member 3"' which extends upwardly and has an end portion 3a" received in a groove of the flange 4". when the hull with the fixed support 4" is turned in one direction under the action of wind, waves and the like, the projection 3a" comes to abutment against the inner wall of the groove in the flange 4", and again a moment is created which stabilizes the vessel. In this embodiment a supporting member is also provided and fixedly connected with the hull. The suspending member 3"' has a spherical part 5", while the supporting member has a substantially spherical recess $3^{iv}$ which receives the substantially spherical part 5". Therefore, during turning of the suspending member 3"' and the fixed support 4" they are guided relative to one another by cooperating formations 5" and $3^{iv}$. The counteracting action of the embodiment shown in FIG. 4 substantially corresponds to the embodiment of FIG. 3, with the exception that in the embodiment of FIG. 4 turning of the ship about any horizontal axis, including a longitudinal horizontal axis, a transverse horizontal axis and any horizontal axes located therebetween, is counteracted by the stabilizing system.

It will be understood that each of the elements described above, or two or more together, may also find a useful application in other types of constructions differing from the types described above.

While the invention has been illustrated and described as embodied in a vessel with stabilizing means, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A vessel such as a ship, a boat and the like, comprising a hull having an inner hollow; a substantially vertical fixed support element fixedly connected with said hull; and a stabilizing element located in said inner hollow, one of said elements having a passage while the other of said elements at least partly freely extending through said passage and being limitedly turnable relative to said one element, so that in the absence of waves, wind and the like said elements are spaced from and do not abut against one another, while when said hull together with said fixed support element turns about a horizontal axis in a first direction under the action of waves, wind and the like, said elements come to abutment against one another and the abutment produces a moment which urges said fixed support element and therefore said hull to turn in a second direction which is opposite to said first direction so as to stabilize the vessel.

2. A vessel as defined in claim 1, wherein said stabilizing element forms said one element while said vertical fixed support element forms said other element, said passage being formed as a substantially vertical passage provided in said stabilizing element and having a lower edge and an upper edge formed so that when said hull together with said fixed support element turn in said first direction, said edges urge said fixed support element to turn in said second direction by applying to said fixed support element a force at two vertically spaced locations corresponding to said edges.

3. A vessel as defined in claim 2, wherein said vertical passage is conical and has one narrower end and another wider end, said wider end being provided with an inwardly extending projection forming one of said edges.

4. A vessel as defined in claim 1, wherein said fixed support element forms said one element, while said stabilizing element forms said other element, said passage being formed as a substantially vertical passage in said fixed support element, said stabilizing element having a suspending member which extends partly through said vertical passage of said fixed support element.

5. A vessel as defined in claim 4; and further comprising a mast fixedly connected with said hull, said mast and said suspending member being provided with interengaging formations allowing turning of said suspending member of said stabilizing element relative to said mast.

6. A vessel as defined in claim 5, wherein said interengaging formations include a substantially spherical projection provided in one of said mast and said suspending member, and a substantially spherical recess provided in the other of said mast and said suspending member and receiving said substantially spherical projection.

7. A vessel as defined in claim 4; and further comprising a supporting member fixedly connected with said hull, said supporting member and said suspending member being provided with interengaging formations allowing turning of said suspending member of said stabilizing element relative to said supporting member.

8. A vessel as defined in claim 7, wherein said interengaging formations include a substantially spherical projection provided on one of said supporting member and said suspending member, and a substantially spherical groove provided on the other of said supporting member and said suspending member and receiving said substantially spherical projection.

9. A vessel as defined in claim 1; and further comprising means for supporting said stabilizing element turnably means to said fixed support element about any horizontal axis.

10. A vessel as defined in claim 9, wherein said supporting means includes interengaging spherical formations provided in said fixed support element and in said stabilizing element.

11. A vessel as defined in claim 9, wherein said supporting means includes interengaging spherical formations provided in said hull and in said stabilizing element.

12. A vessel such as a ship, a boat and the like, comprising a hull having an inner hollow; a substantially vertical fixed support element fixedly connected with said hull; and a stabilizing element located in said inner hollow, one of said elements having a passage while the other of said elements at least partly freely extending through said passage and being limitedly turnable relative to said one element, so that when said hull together with said fixed support element turns about a horizontal axis in a first direction under the action of waves, wind and the like, said elements come to abutment against one another and the abutment produces a moment which urges said fixed support element and therefore said hull to turn in a second direction which is opposite to said first direction so as to stabilize the vessel, said central passage being conical and having one narrower end and another wider end, said wider end being provided with an inwardly extending projection which forms an edge abutting against a wall which limits said passage.

13. A vessel such as a ship, a boat and the like, comprising a hull having an inner hollow; a substantially vertical fixed support element fixedly connected with said hull; and a stabilizing element located in said inner hollow, one of said elements having a passage while the other of said elements at least partly freely extending through said passage and being limitedly turnable relative to said one element, so that when said hull together with said fixed support element turns about a horizontal axis in a first direction under the action of waves, wind and the like, said elements come to abutment against one another and the abutment produces a moment which urges said fixed support element and therefore said hull to turn in a second direction which is opposite to said first direction so as to stabilize the vessel; and further comprising means for supporting said stabilizing element turnably relative to said fixed support element about any horizontal axis.

* * * * *